US006064933A

United States Patent [19]

Rocke

[11] Patent Number: 6,064,933

[45] Date of Patent: May 16, 2000

[54] AUTOMATIC BUCKET LOADING USING TEACHING AND PLAYBACK MODES TRIGGERED BY PILE CONTACT

[75] Inventor: David J. Rocke, Eureka, Ill.

[73] Assignee: Caterpillar Inc., Peoria, Ill.

[21] Appl. No.: 09/079,928

[22] Filed: May 15, 1998

Related U.S. Application Data

[60] Provisional application No. 60/046,725, May 16, 1997.

[51] Int. Cl.[7] ..... E02F 3/43

[52] U.S. Cl. ..... 701/50; 37/414; 37/419; 172/4.5; 172/12

[58] Field of Search ..... 701/50, 124; 37/348, 37/414, 416, 419; 172/4.5, 10, 12; 414/699, 730

[56] References Cited

U.S. PATENT DOCUMENTS 5,274,557 12/1993 Moiya et al. ..... 364/424.07
5,359,517 10/1994 Moiya et al. ..... 364/424.07
5,493,798 2/1996 Rocke et al. ..... 37/348
5,528,843 6/1996 Rocke ..... 37/348
5,875,701 3/1999 Cobo et al. ..... 91/361
5,974,352 10/1999 Shull ..... 701/50

FOREIGN PATENT DOCUMENTS

95/33896 12/1995 WIPO ..... E02F 3/43

*Primary Examiner*—Tan Nguyen
*Attorney, Agent, or Firm*—Steven G. Kibby

[57] ABSTRACT

An electrohydraulic control system for loading a bucket of an earthmoving machine includes sensors for sensing when the machine is crowding a pile of material to be loaded. A command signal generator monitors the sensed "crowd" parameters to trigger one of a learning or playback mode for hydraulic cylinder command signals when the parameter indicates pile contact.

8 Claims, 3 Drawing Sheets

AUTOMATIC BUCKET LOADING USING TEACHING AND PLAYBACK MODES TRIGGERED BY PILE CONTACT

This application claims the benefit of prior provisional patent application Ser. No. 60/046725 filed May 16, 1997.

TECHNICAL FIELD

This invention relates generally to a control system for automatically controlling a work implement of an earthworking machine and, more particularly, to an electrohydraulic system that controls the hydraulic cylinders of an earthworking machine under teaching and playback operations initiated by sensed pile contact to capture material.

BACKGROUND ART

Work machines for moving mass quantities of earth, rock, minerals and other material commonly comprise a work implement configured for loading, such as a bucket controllably actuated by hydraulic cylinders. An operator manipulates the work implement to perform a sequence of distinct functions using one or more control handles to generate operator command signals. In a typical work cycle for loading a bucket, the operator first maneuvers the work machine close to a pile of material and levels the bucket near the ground surface, then directs the machine forward to engage the pile.

The operator subsequently raises the bucket through the pile, "racking" (tilting back) the bucket in order to capture the material. When the bucket is filled or breaks free of the pile, the operator fully racks the bucket and lifts it to a dumping height, backing away from the pile to travel to a specified dump location. After dumping the load, the work machine is returned to the pile to begin another work cycle.

It is increasingly desirable to automate the work cycle in order to reduce operator fatigue. Systems are known which provide teaching and playback functions to perform repetitive digging operations using a hydraulic excavator, such as are disclosed in U.S. Pat. Nos. 5,274,557 and 5,359,517 to Moriya et al. Stored command signals forming a complete dig-transport-dump-return work cycle are repeatedly played back in a closed-loop sequence. There has heretofore been no corresponding functionality provided for tracked or wheeled loaders, in part because operator judgment remains useful for selection of pile entry points and maneuvering the work machine. If playback of a learned loading sequence is begun too soon or too late, the machine may stall or fail to fill the bucket.

At present, operator assistance for a wheel loader typically takes the form of a system for computing implement command signals based upon sensed machine parameters. For example, U.S. Pat. No. 3,782,572 to Gautler discloses a hydraulic control system which monitors wheel torque to automatically increase lift cylinder pressure when wheel slip is detected. U.S. Pat. No. 5,528,843 to Rocke discloses a control system for capturing material which selectively supplies maximum lift and tilt signals in response to sensed hydraulic pressures. International Application No. WO 95/33896 to Dasys et al. discloses sensor feedback for automatic bucket loading, in which the direction of fluid flow to the hydraulic cylinder is automatically reversed when bucket forces exceed allowable limits.

While the foregoing systems advantageously may optimize loading efficiency, depending upon the sophistication of the control algorithm, an operator may prefer to substitute his own judgment and experience to define a "standard" sequence of implement command signals for a wheel loader.

The present invention is directed to overcoming one or more of the problems as set forth above.

DISCLOSURE OF THE INVENTION

Accordingly, it is an object of the present invention to provide automated loading by a work implement.

It is another object to provide signals for controlling a bucket to capture material, particularly aggregate and other homogeneous materials.

It is still another object to provide an automated work cycle for an implement which permits an operator to define a sequence of implement control commands triggered by sensed pile contact.

These and other objects may be achieved with an automatic control system constructed according to the principles of the present invention for loading material using a work implement in accordance with a stored sequence of control command signals. In one aspect of the present invention, the system includes a memory for storing a sequence of operator generated lift and tilt cylinder control commands during a teaching operation triggered by sensed pile contact, and on subsequent passes plays back the stored sequence when triggered by a similar sensed pile contact. An implement controller receives the lift command signals and responsively extends the lift cylinder to raise the bucket through the material, and receives the tilt command signals and controllably moves the tilt cylinder to tilt the bucket to capture the material.

Other details, objects and advantages of the invention will become apparent as certain present embodiments thereof and certain present preferred methods of practicing the same proceeds.

BRIEF DESCRIPTION OF THE DRAWINGS

A more complete appreciation of this invention may be had by reference to the following detailed description when considered in conjunction with the accompanying drawings in which like reference symbols indicate the same or similar components, wherein.

BEST MODE FOR CARRYING OUT THE INVENTION

Figure 1:
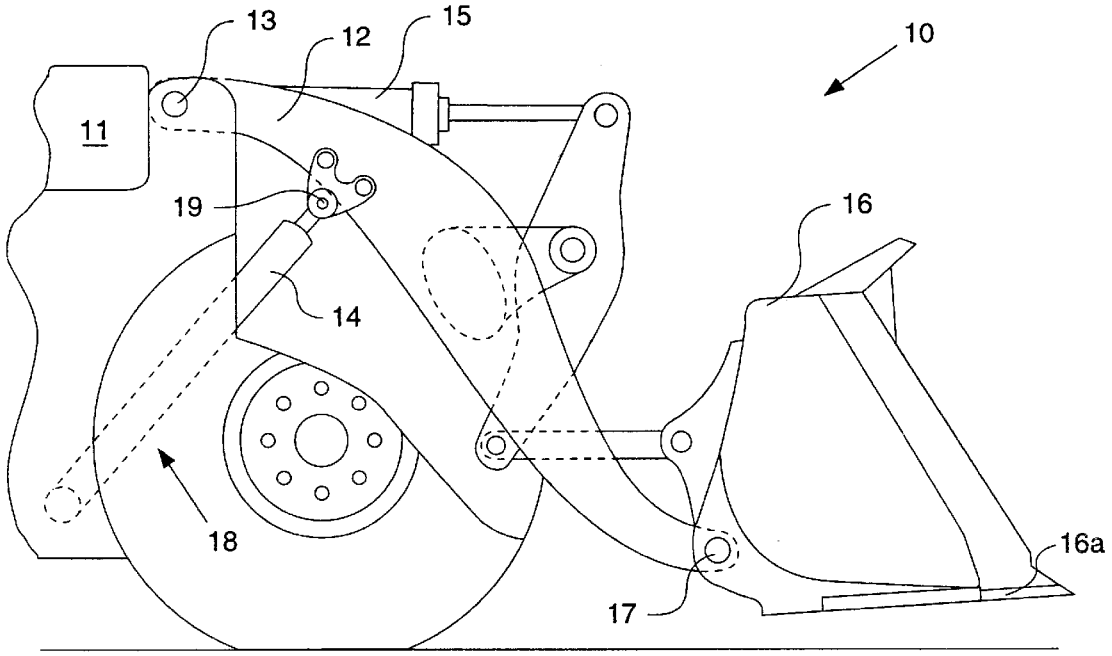
FIG. 1 schematically illustrates a wheel loader and corresponding bucket linkage.

Turning now to the drawings and referring first to FIG. 1, a forward portion of a wheel-type loader machine 10 is shown having a work implement comprising bucket 16 connected to a lift arm assembly 12 and having a bucket tip 16*a*. The lift arm assembly 12 is pivotally actuated by hydraulic lift cylinder 14 about lift arm pivot pins 13 attached to the machine frame 11. Lift arm load bearing pivot pins 19 are attached to the lift arm assembly 12 and the lift cylinder 14. The bucket 16 is tilted back or "racked" by a bucket tilt hydraulic cylinder 15 about bucket pivot pins 17. Although illustrated with respect to a loader moveable by wheels 18, the present invention is also applicable to other machines such as track-type loaders for capturing material.

Figure 2:
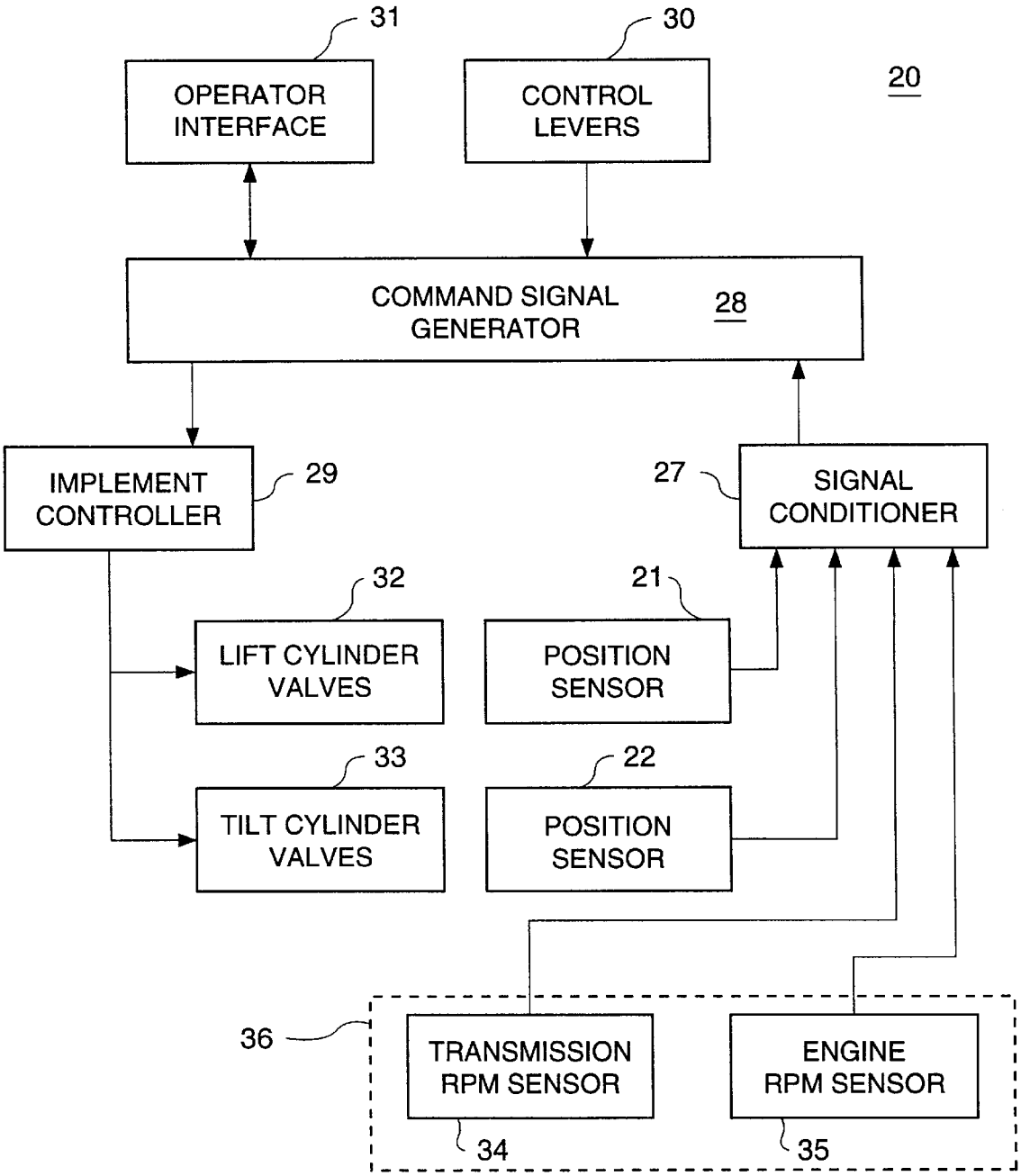
FIG. 2 shows a block diagram of an electrohydraulic system used to automatically control the bucket linkages.

FIG. 2 is a block diagram of an electrohydraulic control system 20 according to one embodiment of the present invention. Lift and tilt position sensors 21, 22, respectively, may optionally be provided to produce position signals in response to the position of the bucket 16 relative to the frame 11 by sensing the piston rod extension of the lift and tilt hydraulic cylinders 14, 15 respectively. Radio frequency resonance sensors such as those disclosed in U.S. Pat. No. 4,737,705 to Bitar et al. may be used for this purpose, or alternatively the position can be directly derived from work implement joint angle measurements using rotary potentiometers, yo-yos or the like to measure rotation at pivot pins 13 and 17.

Torque converter output torque T supplied to wheels 18 is a function of the torque converter input and output shaft speeds, typically being sensed at the engine and drive train on either the transmission, axle or torque converter output shaft. Transmission and engine speed can readily be monitored from a transmission controller 36 using RPM sensors 34, 35, such as passive pickups producing electrical signals responsive to passing gear teeth representative of rotational frequency. A torque converter performance table unique to the specific torque converter design tabulates converter output torque for given torque converter input and output speeds. Additional information from the transmission controller 36 may include direction of rotation, gear selection, and ground speed.

The present invention preferably presumes that little or no wheel slip occurs as the bucket approaches and contacts the pile, and therefore determines a machine ground speed S as a function of sensed transmission, torque converter output shaft or axle speed, with appropriate compensation for transmission or other gear reductions inherent in the drive train.

The position and speed signals may be delivered to a signal conditioner 27 for conventional signal filtering, but are then provided to the command signal generator 28 to sense when a pile has been contacted and trigger the learning and playback functions. The command signal generator 28 is preferably a microprocessor-based system having a read/write memory for storing and reproducing at the same rate a sequence of command control signals produced by joystick control levers 30. By storing and reproducing command signals representative of desired lift/tilt cylinder movement direction and velocity in the same form produced by control levers 30, the present invention can be advantageously retrofit to existing machines by connection to implement controller 29 in parallel with, or intercepting, the manual control lever inputs. Alternatively, an integrated electrohydraulic controller may be provided by combining command signal generator 28 and a programmable implement controller 29 into a single unit in order to reduce the number of components.

The implement controller 29 includes hydraulic circuits having lift and tilt cylinder control valves 32, 33 for controlling the rate at which pressurized hydraulic fluid flows to respective lift and tilt hydraulic cylinders in proportion to received velocity command signals, in a manner well known to those skilled in the art. Lift and tilt hydraulic cylinder velocity command signals are for brevity referred to hereinafter as lift or tilt commands or commands signals.

In operation, the command signal generator 28 is "taught" a desired sequence by sampling at least lift and tilt command signals produced by operator movement of control levers 30. A loader is driven toward a pile of material to be loaded, typically after first orienting the bottom of the bucket nearly level and close to the ground. As the bucket tip contacts and begins digging into the pile, the operator generates command signals to lift and rack the bucket through the material while continuing to drive the machine forward, referred to herein as "crowding" the pile.

According to one aspect of the present invention, command signal generator 28 begins storing operator produced commands as part of a learned sequence only after pile contact is triggered as a function of at least one sensed parameter indicative of pile crowding, as discussed hereinafter. Command signal generator 28 then continues to store operator produced commands at regular intervals until a switch is operator indicating the loading cycle is complete, or a preset time interval has elapsed. Thereafter, playback is begun when similar conditions are sensed.

Some operators may chose to reposition the bucket or select a different transmission gear prior to contacting the pile. According to another aspect of the present invention, command signal generator 28 may additionally store as part of the learned sequence command signals generated for some interval prior to sensed pile contact. Playback of these pre-contact command signals might then be initiated manually by operator on subsequent work cycles.

Figure 3:
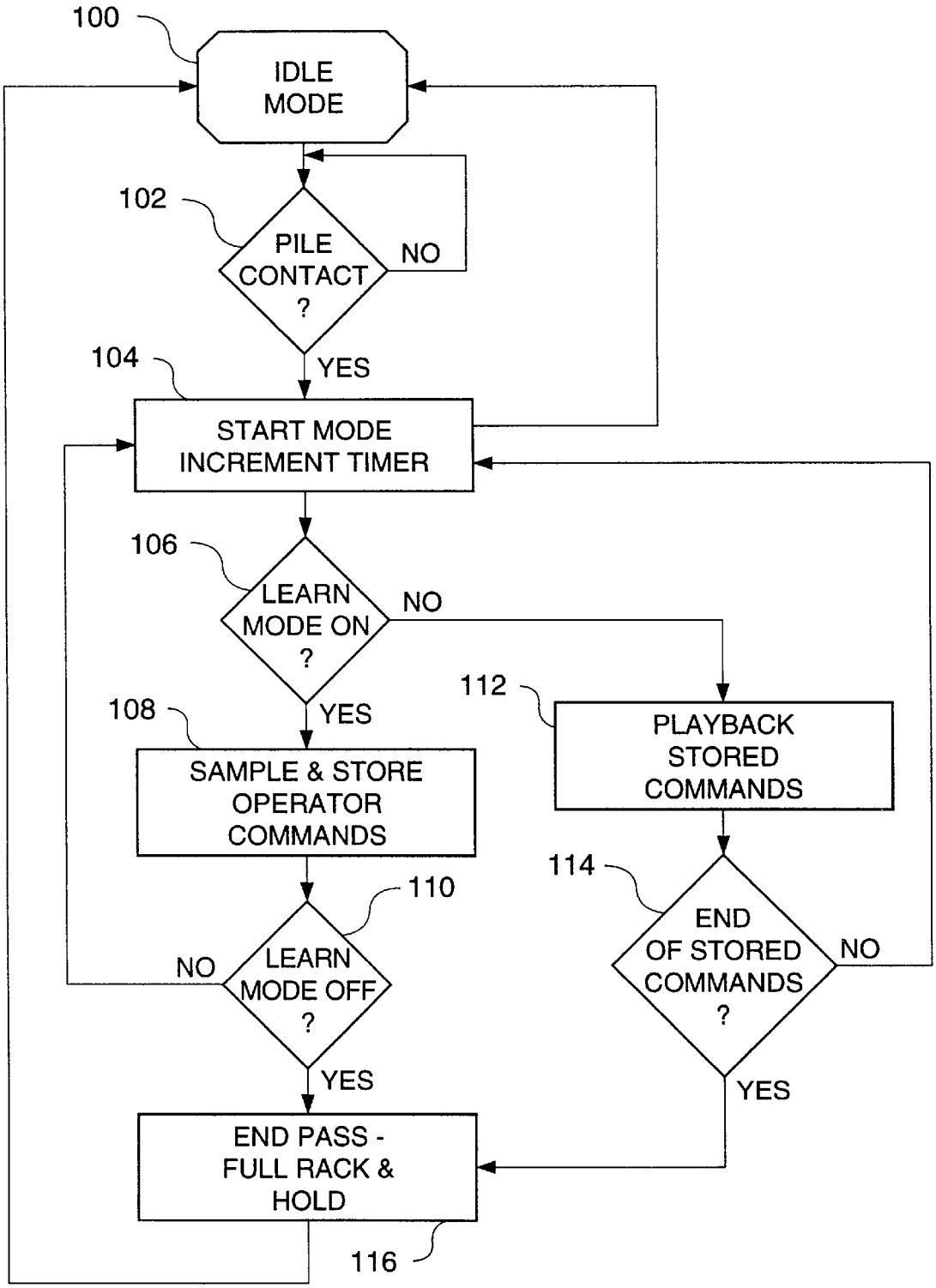
FIG. 3 is a flowchart of program control to automatically capture material using a teaching and playback function.

FIG. 3 is a flow chart of a present preferred embodiment of the invention, which may be implemented in program logic performed by command signal generator 28. In the description of the flowchart, the functional explanation marked with numerals in angle brackets, <nnn>, refers to blocks bearing that number.

Program control initially begins at a step <100> when a MODE variable is set to IDLE. MODE will be set to IDLE in response to the operator actuating a switch for enabling automated bucket loading control. While program control is in an IDLE MODE, command signal generation is preferably inhibited until some initial conditions are satisfied to ensure that automatic bucket loading is not engaged accidentally or under unsafe conditions. Such conditions may include:

- Machine speed within a specified range, such as between one third top first gear speed and top second gear speed.
- Control levers 30 substantially in a centered, neutral position, (a slight downward command may be allowed to permit floor cleaning).
- Transmission shift lever in a low forward gear, eg. first through third, and at least a predetermined time has elapsed since the last upshift.

The operator directs the machine into the pile of material, preferably at close to full throttle by the time the pile is fully engaged, while the program control monitors a sensed value indicative of pile crowding, such as drive line torque T, to determine when the machine has contacted the pile <102>. In a preferred embodiment, MODE is set to START <104> when command signal generator 28 determines that a torque crowd factor has exceeded a set point A and continues to increase. Additional parameters may be monitored as a cross check, such as whether machine ground speed is simultaneously decreasing or whether the crowd factor continues to increase for a predetermined duration. Such a cross check ensures, for example, that increased torque is not interpreted incorrectly as a pile contact when in fact it is caused by acceleration of the machine.

In the START MODE, a timer is incremented to index a sequence of commands, and to determine whether a time out condition has occurred indicating the operator has neglected to terminate the learning mode or that the bucket has become stalled in the pile. The time out period is set to a relatively high value to essentially halt automatic operation by returning to IDLE MODE 100 under conditions indicating a learning or playback error has occurred.

If a time out condition has not occurred, command signal generator 28 determines in step <106> whether the operator has designated a learning mode, such as by engaging a "learn" switch, and if so program control continues to step <108> to sample and store operator command signals produced by movement of control levers 30. A data array comprises three values: time and position of lift and tilt levers 30.

Optionally, command signal generator may also reproduce and store a transmission downshift command to a transmission controller to cause the transmission to be placed in a lower gear by an automatic downshift routine (not shown), in order to match machine characteristics to a selected aggressiveness or material condition. Reducing the transmission to the lowest gear upon contacting the pile permits the operator to quickly travel between loading and dumping locations while at the same time automatically ensuring maximum torque is available to crowd the pile.

The teach system will only record a data array if gear selection changed (i.e., downshift) or if lift or tilt lever position changed at least 10% relative to the last data array recorded. In the learning mode, operator command signals are sequentially stored in a temporary memory of command signal generator 28 until disengagement of the "learn" switch is detected in step <110>, whereupon the sequence of commands are recorded in a non-volatile memory such as a flash PROM.

Upon completion of the learning mode, command signal generator 28 executes in step <116> and END PASS routine if the bucket is not yet fully racked, produced predetermined command signals to cause the tilt cylinder to extend at maximum velocity, optionally followed by signals to extend the lift cylinder at maximum velocity to a given height up to the maximum extension.

In an alternative embodiment, command signal generator 28 may prematurely terminate the learning or playback modes automatically by comparing the lift and/or tilt cylinder extensions to set points including:

Whether the extension of the tilt cylinder is greater than an set point B, such as 0.75 radians, indicating that the bucket is almost completely racked back; or Whether the extension of the lift cylinder is greater than a set point F, indicating that the bucket has likely broken free of the pile.

On subsequent passes of the machine into the pile, a PLAY BACK mode is similarly triggered by a sensed condition indicating pile crowding <102>, by shifting program control in step <106> to a playback step <112> when a "learn" mode switch is not actuated. In step <112>, stored operator tilt and lift command signals are reproduced in sequence in correspondence with the incremental timer to generate command signals for the same time duration over which the learning cycle was recorded. When command signal generator determines in step <114> that all stored commands have been replayed, an END PASS routine is executed to prepare the bucket for travel to a dumping location, as previously described.

The operator may regain manual control over the bucket 16 at any time during the play back operation by moving either one of control levers 30 out of the neutral range to abort the program control. Otherwise, the bucket remains racked at full extension following completion of step <116> until the operator manually dumps the bucket 16 at a dump location or a subsequent automatic routine assumes control.

INDUSTRIAL APPLICABILITY

Features and advantages associated the present invention are best illustrated by description of its operation in relation to a wheel loader using changes in drive train torque to sense pile contact. The present invention has primary utility under conditions were a relatively homogeneous material, such as aggregate, is being loaded in repetitive passes.

The non-volatile memory may be provided with a selector to indicate which of a plurality of stored operator command signal sequences should be used. In this manner, a play back sequence can be configured for many different operators or material conditions.

If an operator wants to use the same taught sequence for a variation of material, he should teach the system in the hardest end of the spectrum. If taught in a lighter or looser material, the replay may lack bucket fill at the harder end of the spectrum.

Teaching and playback are initiated in response to sensed pile contact. Pile contact can be sensed by monitoring changes in torque, ground speed, and hydraulic cylinder pressure, or any combination thereof. Minor changes are ignored, as potentially being caused by rough terrain or operator actions. Variations in the ground speed alone may indicate simply a change in engine speed, while changes in hydraulic pressure due to pile contact may be masked by the slight downward pressure used for ground clearing. Accordingly, in a preferred embodiment, pile contact for purpose of triggering a START MODE begins when a factor representing drive line torque exceeds a set point and continues to increase at the same time ground speed is decreasing. A torque set point of about thirty percent maximum torque has been found satisfactory.

While certain present preferred embodiments of the invention and certain preferred methods of practicing the same have been illustrated and described herein, it is to be distinctly understood that the invention is not limited thereto but may be otherwise variously embodied and practiced within the scope of the following claims.

What is claimed is:

1. A control system for automatically controlling a bucket of an earthmoving machine to capture material, the bucket being controllably actuated by a hydraulic tilt cylinder and lift cylinder, the system comprising:

sensing means for sensing parameters indicative of resistance to bucket movement through a material pile and producing sensed parameter signals;

command signal generating means for receiving said parameter signals, and triggering one of a learning mode for storing operator command signals and a playback mode for playing back stored operator command signals responsive to a sensed pile contact by comparison of said parameter signals with a set point; and a hydraulic implement controller for modifying hydraulic fluid flow to said cylinders in response to said command signals.

2. The control system of claim 1, further comprising operator control levers for generating hydraulic cylinder lift and tilt operator command signals, wherein in said learning mode said command signal generating means stores a data array comprising said lift and tilt operator command signals as a data array at regular timed intervals.

3. The control system of claim 2, wherein at each said time interval the operator command signals stored in said data array remain constant unless said lever position has been changed by at least predetermined amount in proportion to a previously stored command signal.

4. The control system of claim 1, said sensing means comprising means for sensing transmission speed and engine speed and producing a said sensed parameter signal representative of drive train torque, said command signal generating means responsively triggering one of said learning and playback modes when said torque exceeds a predetermined set point.

5. The control system of claim 1, further comprising said command signal generator means terminating said learning and playback modes responsive to one of expiration of a predetermined time interval and said bucket reaching a predetermined position.

6. The control system of claim 1, further comprising said command signal generator means generating a transmission shift signal responsive to said sensed pile contact.

7. A method for automatically controlling a bucket of an earthmoving machine to capture material, the bucket being controllably actuated by a hydraulic tilt cylinder and lift cylinder, the method comprising:

sensing parameters indicative of resistance to bucket movement through a material pile and producing sensed parameters signals;

receiving said parameter signals, and triggering one of a learning mode for storing operator command signals and a playback mode for playing back stored operator command signals responsive to a sensed pile contact by comparison of said parameter signals with a set point; and modifying hydraulic fluid flow to said cylinders in response to said command signals.

8. The method of claim 1, said sensing step further comprising sensing transmission speed and engine speed and producing a said sensed parameter signal representative of drive train torque, and said command signal generation responsively triggering one of said learning and playback modes when said torque exceeds a predetermined set point.

* * * * *

UNITED STATES PATENT AND TRADEMARK OFFICE

CERTIFICATE OF CORRECTION

PATENT NO. : 6,064,933
DATED : May 16, 2000
INVENTOR(S) : David J. Rocke

It is certified that error appears in the above-identified patent and that said Letters Patent is hereby corrected as shown below:

Column 8,
Line 7, delete "1" and insert -- 7 --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*